United States Patent [19]

Schnetker

[11] Patent Number: 4,651,709

[45] Date of Patent: Mar. 24, 1987

[54] FUEL BURNING STOVE

[76] Inventor: Hellmut Schnetker, 271 Milperra Road, Revesby, New South Wales, 2212, Australia

[21] Appl. No.: 648,166

[22] PCT Filed: Dec. 22, 1983

[86] PCT No.: PCT/AU83/00192

§ 371 Date: Aug. 21, 1984

§ 102(e) Date: Aug. 21, 1984

[87] PCT Pub. No.: WO84/02568

PCT Pub. Date: Jul. 5, 1984

[30] Foreign Application Priority Data

Dec. 23, 1982 [AU] Australia ..... PF7436

[51] Int. Cl.[4] ..... F24C 1/14

[52] U.S. Cl. ..... 126/77; 126/4; 126/83; 126/193; 126/287.5; 126/290; 110/211; 110/214

[58] Field of Search ..... 126/4, 58, 65, 66, 67, 126/69, 77, 80, 83, 285 R, 287.5, 288, 289, 290, 193; 422/177, 180; 110/203, 210, 211, 214

[56] References Cited

U.S. PATENT DOCUMENTS

| | | | |
|---|---|---|---|
| 1,752,007 | 3/1930 | Kline | 126/202 X |
| 4,319,556 | 3/1982 | Schwartz et al. | 126/77 |
| 4,368,722 | 1/1983 | Lynch | 126/77 |
| 4,404,953 | 9/1983 | Thulman et al. | 126/77 |
| 4,409,956 | 10/1983 | Barnett | 126/290 |
| 4,458,662 | 7/1984 | Barnett | 126/77 |
| 4,461,273 | 7/1984 | Barker et al. | 126/77 |
| 4,479,921 | 10/1984 | Allaire et al. | 422/180 |
| 4,494,525 | 1/1985 | Albertsen | 126/289 |

*Primary Examiner*—Margaret A. Focarino

[57] ABSTRACT

A stove to burn solid fuels, said stove comprising a combustion chamber with a front (13) with a fuel charging aperture (14) therein and a door (3) with a transparent viewing panel (33) therein mounted over the aperture (14), a baffle (15) dividing the interior of the combustion chamber into a primary combustion zone (A) and a secondary combustion zone (B), a closeable port (16) in the baffle (15) connecting the primary and secondary combustion zones, a combustion gas discharge port (17) to atmosphere from the secondary combustion zone, a gas screen (24) in the gas path between the primary and secondary combustion zones, the gas screen being constructed from materials that will glow at a temperature below the ignition temperature of combustion gases, primary and secondary combustion air inlets (22 and 30) discharging into the combustion zone adjacent a top edge of the door panel (33) and the gas screen (24) respectively, manually resettable temperature actuated flow control means (34) regulating the amount of primary combustion air entering the combustion chamber.

5 Claims, 3 Drawing Figures

FUEL BURNING STOVE

BACKGROUND OF THE INVENTION

This invention relates to solid fuel burning stove and in particular to stoves of the above type that burn solid fuels which develop smoke with a high soot content as a result of incomplete combustion. An example of the foregoing is a wood burning stove.

Stoves of the above type have as desirable features complete combustion of fuel even at low temperatures, after-burning of the primary combustion gases and means to provide a soot free transparent viewing window (if a window is fitted) so that the owners of the stove can watch the fuel burning process. Attempts have been made to provide stoves having all of the above features, however in the area of maintaining substantially complete combustion for a range of combustion air intakes difficulties have arisen, largely because of the controls that have been used for the combustion cycle.

In general, stoves for burning solid fuels comprise a combustion chamber with a draft generating flue provided with a damper to regulate the drawing ability of the flue and an air inlet with a flow control operable between a fully open condition (designed to provide sufficient combustion air to allow the stove to perform up to the maximum designed level) and a fully closed condition. In most stoves reliance is put upon leakage of air into the combustion chamber to maintain a slow combustion rate when the air inlet is closed off. This makes the operation of the stove easy for the user because if slow combustion is required then it is simply a matter of closing off the air inlet completely and relying on the air leakage into the combustion chamber to sustain combustion. The problem is that the amount of air leaked into the combustion chamber depends on many factors and can vary substantially from stove to stove of the same make and therefore efficient combustion in the slow combustion mode of operation cannot be guaranteed. If incomplete combustion occurs where wood is the fuel smoke and creosote can be generated. If this continues there will be a build up of soot in the flue from the combustion chamber and on the inner surface of the combustion chamber, including the viewing window if one is fitted. It is known that if a stream of air is directed across the inner face of a viewing window of a combustion chamber the window will be maintained substantially clear of soot irrespective of the rate of combustion occuring in the combustion chamber.

One aspect of the present invention is the provision of a permanent supply of combustion air to the combustion chamber which is sufficient to maintain substantially complete, but slow, combustion when the combustion air control means is in the appropriate position. The invention also provides an air supply which is directed so as to inhibit the deposition of any soot which results from the combustion process on the inner surface of the viewing panel provided in the stove. A further feature of the invention is a catalytic means to ensure ignition of the products of primary combustion in a secondary combustion zone of the combustion chamber.

SUMMARY

Broadly stated the invention can be said to comprise a stove to burn solid fuel, said stove having a combustion chamber defined by a casing including at least a top, a back, two sides and a front, a door including a transparent viewing panel, said door is hingedly connected to the casing to cover a fuel charging aperture in the casing front, a baffle within the combustion zone, said baffle extends from side to side of the casing and forwardly from the back of the casing and terminates in a leading edge adjacent the casing front so as to provide a lower primary combustion zone and an upper but smaller secondary combustion zone, a combustion gas discharge opening through the casing connecting the secondary combustion chamber to atmosphere, a closable port in the baffle adjacent the back of the casing and connecting the primary and secondary combustion zones, a combustion gas screen at the leading end of the baffle separating the primary and secondary combustion chambers, a secondary combustion air intake passage open to the atmosphere and having a discharge end adjacent the leading end of the baffle, primary combustion air intake passage means open to atmosphere and having a discharge to direct primary combustion air over the inner surface of the viewing panel, control means including a manual primary adjustment and a temperature controlled secondary adjustment to regulate the quantity of primary combustion entering said passage means.

BRIEF DESCRIPTION OF THE DRAWINGS

A presently preferred embodiment of the invention will now be described with reference to the accompanying drawings in which.

DETAILED DESCRIPTION OF THE PREFERRED EMBODIMENT

Figure 1:
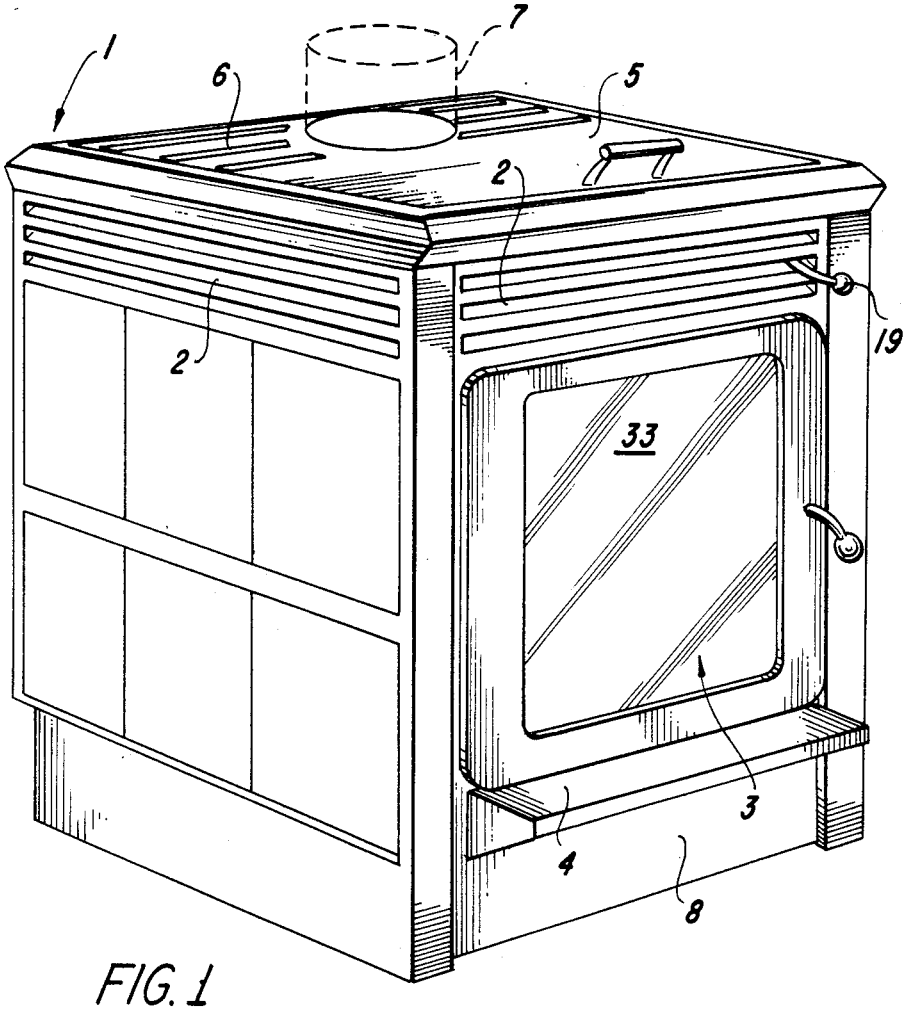
FIG. 1 is a perspective view of a stove according to the invention.
Figure 2:
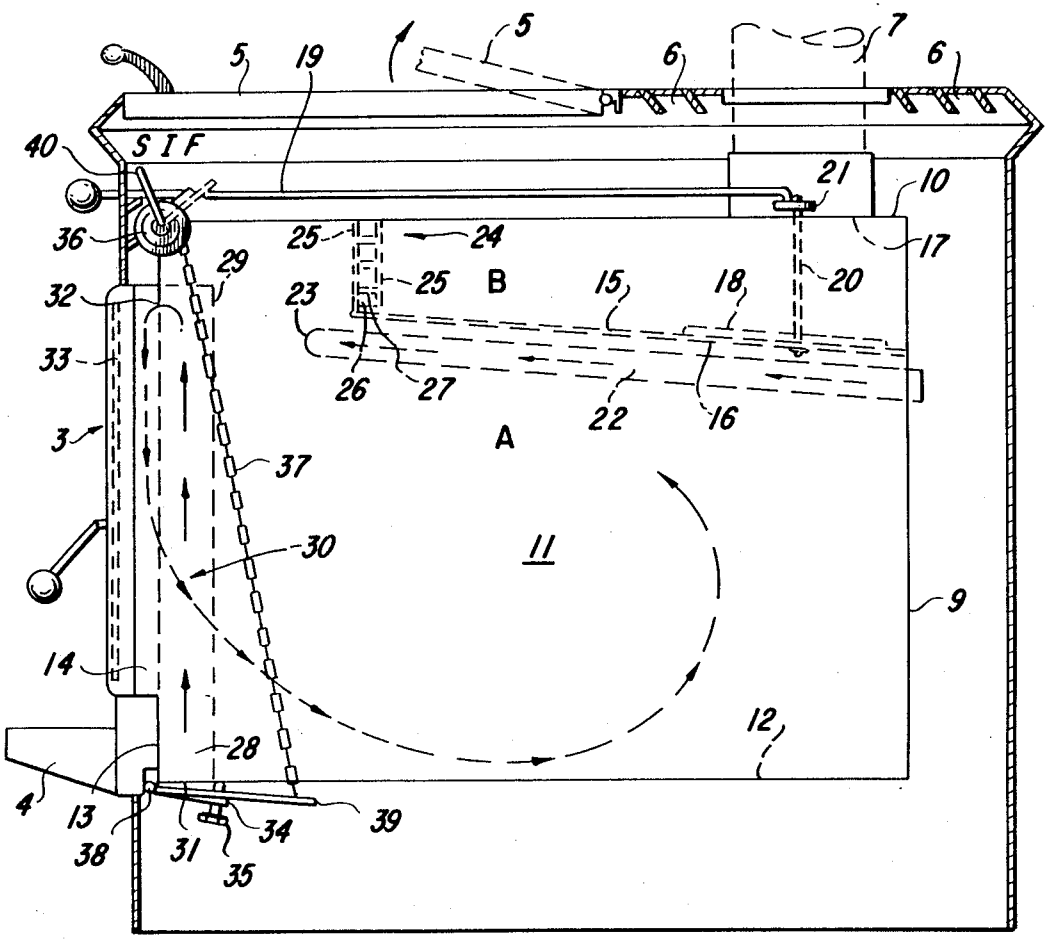
FIG. 2 is a side view of the stove of FIG. 1 with the casing at one side of the firebox removed and FIG. 3 is a plan view with the top of the firebox removed to allow the internal parts of the firebox to be seen.
Figure 3:
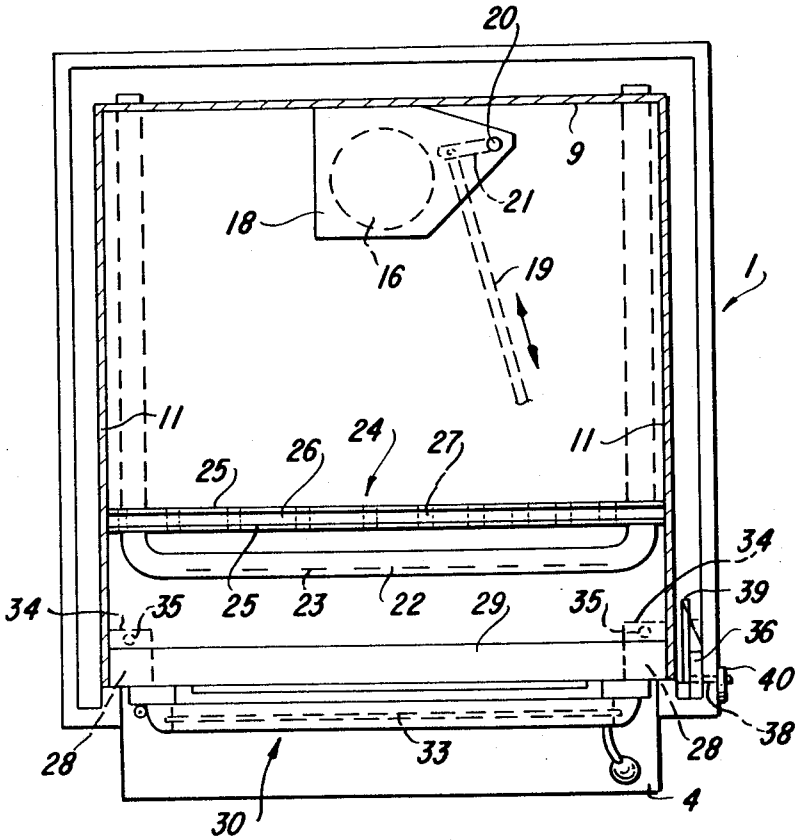

The stove comprises an outer decorative casing 1 including louvres 2. The casing comprises sides, a top and a back and a partial front. The casing is mounted on and around a firebox which stands on a plinth 8. There is a door 3 mounted on the firebox so as to be accessible through the partial front of the casing 1. An ash spill tray 4 is located below the door 3.

The casing top includes a lift-up door 5 to permit cooking by use of cookware placed on top of the firebox. There are louvres 6 in the top of the casing to facilitate convection circulation of air over the firebox and there is a flue 7 extending through the casing top whereby combustion gases are discharged from the firebox.

The firebox comprises a back 9, a top 10, two sides 11, a bottom or hearth 12 and a front 13 having a fuel charging aperture 14 over which the door 3 is hingedly mounted. Fixed within the firebox there is a baffle plate 15 which extends from side to side of the firebox and extends forwardly from the back of the firebox terminating in a front edge spaced from the front of the firebox. The baffle plate 15 divides the firebox interior into a lower combustion zone A and a smaller upper combustion zone B. Preferably the baffle is inclined upwardly forwardly as shown in the drawings but this is not an essential.

There is a hole 16 through the baffle plate 15 interconnecting the upper and lower combustion zones, the hole 16 is aligned with hole 17 through the top of the firebox with an associated flue coupling collar and the holes 16 and 17 are approximately the same size. The hole 17 can be located in the back 9 of the firebox if a rear discharge for combustion gases is required. In such a case the flue would not exit through the top of the casing and the louvred top of the casing would be suitably modified.

There is a slidable cover 18 adapted to be placed over the hole 16 by operation of the handle/rod assembly 19 which exits from the front of the casing. The cover is fixed on a shaft 20 having ends mounted in bearing holes in the firebox top and the baffle plate 15 and the rod 19 is coupled to an arm 21 fixed to the shaft 20 above the top 10 of the firebox so that the cover movement is arcuate about the shaft 20. Located below the baffle plate 15 there is a U shaped secondary air inlet pipe 22 which takes air from the rear of the firebox, although the position at which the pipe 22 exits from the firebox is optional. The base of the U is adjacent the front edge of the baffle plate 15 and is provided with discharge ports 23 which are forwardly directed.

A grid 24 is located in the mouth to the upper combustion zone, i.e. between the front edge of the baffle and the top of the firebox. The grid plays an important part in the efficient working of the stove. The grid comprises two plates 25 with a layer of fibrous material 26 sandwiched therebetween and there are holes 27 through the sandwiched assembly to provide the grid effect. The plates 25 are made of heat resistant non-corroding light gauge metal, for example stainless steel of 1.2 mm thick. The fibrous material is preferably that known by the trade name Kaowool and is made from refractory fibre compositions, as used it is in the form of a board. The function of the grid will be described later.

The aperture 14 in the front of the firebox is rectangular and on the two upright sides and the top it is respectively bordered by the legs 28 and the base 29 of a U shaped tubular member 30. The open ends 31 of the legs 28 extend through the bottom of the firebox so as to draw primary combustion air from outside the stove. The base 29 has slot openings 32 therein which are adapted to direct the primary combustion air entering the firebox through the member 30 downwardly over the inner face of the glass panel 33 in the door 3.

The flow of primary combustion air into the open ends 31 of the legs 28 has a predetermined minimum and maximum and is controlled by the position of flap members 34 fixed to a common shaft 38 pivotally mounted in bearing means on the bottom of the firebox with the flaps 34 aligned with the ends 31 of the legs 28. To provide a minimum flow there is a stop screw 35 of adjustable length on each flap 34 to engage against the bottom of the firebox.

The position of the flaps is determined by manual and temperature controlled means. The temperature controlled means comprises a bi-metal spring coil 36 with a free end connected through link means 37 (preferably a chain) to a lever arm 39 on the shaft 38. The inner end of the coil 36 is mounted on a plate which can be moved about its connection to the firebox so that the coil 36 can be rotationally positioned in accordance with required burning characteristics for the fire. In a first position the plate is positioned so that a plate moving handle 40 points to the letter S to bring to stop screws 35 into close proximity to the bottom of the firebox. The combustion will now be slow because of the small quantity of air available. There will be heat generated which will cause the coil to expand the bring the screws 35 against the firebox bottom thereby limiting the amount to which the combustion air can be restricted. As the combustion slows due to the reduction of available air the coil will contract and the flaps will open again to the limit allowed by the contracted coil. Thus there will be a repeated opening and closing of the flaps over a low temperature range.

At the other end of the operating scale the handle is set to F where the flaps are fully open allowing a superabundance of combustion air to enter the firebox. As the fire heat increases the coil will expand closing the flaps to a degree dependent upon the deflection of the coil. When the fire heat decreases as a result of partial flap closure the coil will contract again thereby opening the flaps. Thus there will be repeated opening and closing of the flaps for a predetermined high temperature range.

When the handle is set to I the flap opening and closing cycle will also occur but for an intermediate temperature range. The burning cycle includes primary combustion and secondary combustion. Once the fire has achieved a required operating temperature the damper 18 is closed over and the products of primary combustion are forced to pass through the grid holes 27 in order to reach the flue. The temperature within the firebox is such as to cause the edges of the holes 27 to glow and the non-combustible fibres of the Kaowool around the holes 27 to glow. This source of ignition in the presence of combustible gases (from the primary combustion phase) in an atmosphere rich in combustion air (from the pipe 22) provides the ideal conditions for secondary combustion into the secondary combustion zone. The result is that the gases exhausted from the secondary combustion zone are substantially devoid of combustible material thereby ensuring the maximum heat energy extraction from the fuel consumed on the stove.

If desired the case around the firebox can be fitted with heat radiant surfaces or members such as ceramic tiles.

I claim:

1. A stove to burn solid fuel, said stove having a combustion chamber defined by a casing including at least a top, a back, two sides and a front, a door including a transparent viewing panel, said door being hingedly connected to the casing to cover a fuel charging aperture in the casing front, a baffle within the combustion chamber, said baffle extending from side to side of the casing and forwardly from the back of the casing and terminating in a leading edge adjacent the casing front so as to provide a lower primary combustion zone and an upper but smaller secondary combustion zone, a combustion gas discharge opening through the casing connecting the secondary combustion zone to the atmosphere, a closable port in the baffle adjacent the back of the casing and connecting the primary and secondary combustion zones, a combustion gas screen extending between the leading edge of the baffle and the top of the chamber and separating the primary and secondary combustion zones, a secondary combustion air intake passage open to the atmosphere and having a discharge edge adjacent the leading end of the baffle, primary combustion air intake passage means open to atmosphere and having a discharge to direct primary combustion air over the inner surface of the viewing panel, control means including a manual primary adjustment means and a temperature controlled secondary adjustment means to regulate the quantity of primary combustion entering said primary combustion air intake passage means.

2. A stove as claimed in claim 1 wherein said combustion gas screen comprises a perforated metal plate made of a material and a gauge that will glow at a temperature below the ignition temperature of the gaseous products of combustion of solid fuels.

3. A stove as claimed in claim 2 wherein the perforated metal plate is one of two such plates spaced by a layer of refractory fibre composition having perforations aligned with those of the metal plates.

4. A stove as claimed in claim 3 wherein said passage means comprises a pair of tubes located one to each side of said fuel charging aperture and within said stove and header joining the tubes and outlets in said header for said primary combustion air.

5. A stove as claimed in claim 4 wherein the control means includes a bimetal coil connected through a link to a lever on a rotatable shaft on which there are flaps aligned with primary combustion air inlet ports to said tubes closure stops to provide a minimum spacing of said flaps from said combustion air inlet ports and said bimetal coil is rotatably mounted to allow the flaps to be manually located between said minimum spacing and a predetermined maximum spacing from said combustion air inlet ports.

* * * * *